US008672714B2

(12) United States Patent
Wu et al.

(10) Patent No.: US 8,672,714 B2
(45) Date of Patent: Mar. 18, 2014

(54) HDMI AUDIO-VIDEO SIGNAL SWITCHING DEVICE

(75) Inventors: Kuo-Ming Wu, Taipei (TW); Yun-Chen Yen, Taipei (TW)

(73) Assignee: Hsing Chau Industrial Co., Ltd. (TW)

( * ) Notice: Subject to any disclaimer, the term of this patent is extended or adjusted under 35 U.S.C. 154(b) by 89 days.

(21) Appl. No.: 13/338,457

(22) Filed: Dec. 28, 2011

(65) Prior Publication Data

US 2013/0171882 A1 Jul. 4, 2013

(51) Int. Cl.
*H01R 25/00* (2006.01)

(52) U.S. Cl.
USPC ..... 439/638; 439/660

(58) Field of Classification Search
USPC ..... 439/638, 660, 607.01
See application file for complete search history.

(56) References Cited

U.S. PATENT DOCUMENTS 6,508,674 B1 * 1/2003 Svenkeson et al. ..... 439/631
6,840,796 B2 * 1/2005 Marcinkiewicz et al. .... 439/495
6,988,914 B2 * 1/2006 Pepe et al. ..... 439/638
7,494,383 B2 * 2/2009 Cohen et al. ..... 439/638
7,628,657 B2 * 12/2009 Martich ..... 439/676

* cited by examiner

*Primary Examiner* — Hien Vu
(74) *Attorney, Agent, or Firm* — Schmeiser, Olsen & Watts, LLP

(57) ABSTRACT

An HDMI audio-video signal switching device comprises two housing bodies and a conductively connecting circuit board. Each of the housing bodies has an assembling end and a plugged end. The conductively connecting circuit board is a circuit board formed, at each end thereof corresponding to a positioning slot of each housing body, with a plugging projection sheet. Each plugging projection sheet has conductively connecting terminals. A portion of the conductively connecting circuit board between the two plugging projection sheets is set in the positioning slot, such that each plugging projection sheet and conductively connecting terminals thereon are allowed to pass through the positioning slot and then extend into a plugged hole, as well as the assembling ends of the two housing bodies are allowed to be butted and assembled together. Thereby, a more simplified structure is introduced for the HDMI audio-video signal switching device.

9 Claims, 6 Drawing Sheets

HDMI AUDIO-VIDEO SIGNAL SWITCHING DEVICE

FIELD OF TECHNOLOGY

The present invention is related to an HDMI audio-video signal switching device, particularly to the HDMI audio-video signal switching device with simplified structure.

BACKGROUND

The present high definition multimedia interface (HDMI) is a technology capable of transmitting audio signal and video signal simultaneously, allowed for replacing old-type transmission interface separately used for video signal and audio signal, as well as usually applied for electronic products, such as DVD players, personal computers, television games, digital audios and etc., in which transmission of audio-video signals is required. A dedicated HDMI signal line is necessary for connection when HDMI is used. However, insufficient length of the HDMI signal line occurs frequently in actual use. In this case, only an HDMI switcher is used for connecting two HDMI signal lines in series, so as to obtain an extended line having an adequate length.

Referring to FIGS. 1 and 2, there is shown a conventional HDMI switcher, mainly comprising a circuit board 10, two HDMI connectors 20, and two housing bodies 30. The circuit board 10 is provided with circuits and welding points necessary for connecting the two HDMI connectors 20 in series. Each HDMI connector 20 comprises a metallic housing 201, and a connecting sheet 202 assembled within the metallic housing 201. One face of the metallic housing 201 is punched to provide two fastening resilient sheets 203, and each of two surfaces of the connecting sheet 202 is provided with several terminals, each of which is extended to the bottom of the metallic housing 201. The housing body 30 is a rectangular hollowed-out insulating housing provided, at an plugged end thereof, with a plugged hole 301 communicated with the interior. Thereby, the HDMI switcher having two ends to be plugged with HDMI signal lines may be formed, by firstly welding the two HDMI connectors 20 onto different surfaces of the circuit board 10 at two ends of this circuit board, respectively, subsequently covering the two ends of the circuit board 10 by the two housing bodies 30, respectively, in such a way that the two housing bodies 30 are used to cover the circuit board 10 and the HDMI connectors 20, and the plugged holes 301 are corresponded to the HDMI connectors 20, respectively, as well as finally assembling the two housing bodies 30 by performing ultrasonic fusing.

However, it is found, in above structure, that the structure of conventional HDMI switcher is excessively complicated, and must be subject to the manufacturing of the circuit board 10, HDMI connectors 20 and housing bodies 30, respectively, followed by assembling procedures including welding, assembling and ultrasonic fusing, leading to the problems of complex manufacturing process, difficult quality control, excessively high production cost and etc.

Therefore, how to invent a novel HDMI switcher allowed for conquering the problems and drawbacks of the conventional HDMI switcher is disclosed as desired positively by the present invention.

SUMMARY

In view of above drawbacks of above technology, Inventor then exhausted himself to give utmost attention to research so as to conquer the imperfection, depending on experience accumulated on engaging in this industry for many years, and further research and develop an HDMI audio-video signal switching device, for achieving the object of simplifying structure as desired.

For achieving above objects, the present invention provides an HDMI audio-video signal switching device, comprising a first housing body and a second housing body, each having an assembling end butted together, a plugged end opposite to the assembling end, a positioning slot depressingly provided at the assembling end, and a plugged hole depressingly provided at the plugged end, the positioning slot communicating with the plugged hole and the shape of the plugged hole corresponding to that of an HDMI signal line plug; and a conductively connecting circuit board formed, at each of two ends thereof, with a plugging projection sheet, a portion between the plugging projection sheets being provided in the positioning slots, the plugging projection sheets being provided in the plugged holes, respectively, the plugging projection sheets being used for connecting to the HDMI signal line plugs, two surfaces of each of the plugging projection sheets being provided thereon with a plurality of conductively connecting terminals in parallel, the conductively connecting terminals being used to be electrically connected with the HDMI signal line plugs, and the conductively connecting terminals of one plugging projection sheet being electrically connected with those of the other, correspondingly.

Therefore, a more simplified structure is provided for the HDMI audio-video signal switching device of the present invention, in which the circuit board of the conductively connecting circuit board directly formed with the plugging projection sheets and conductively connecting terminals required for connecting with the HDMI signal line plugs, together with the shape design of the positioning slots and plugged holes of the first housing body and second housing body, may be used, such that the structure of HDMI audio-video signal switching device to be plugged with the HDMI signal line plugs is then formed when the plugging projection sheets of the conductively connecting circuit board are inserted into the positioning slots and then extended to the plugged holes of the first housing body and second housing body. In this way, the use of metallic housing structure of the conventional HDMI connector, together with the manufacturing process of welding the conventional HDMI connector onto the circuit board, may be eliminated in the present invention, so as to achieve the effects of simplified structure and easy to manufacture and assemble, as well as obtain the benefit of cost reduction.

BRIEF DESCRIPTION

DETAILED DESCRIPTION

A detailed description will be made to the present invention by means of following embodiments in cooperation with accompanied drawings for fully understanding the objects, features and effects of the present invention.

Figure 1:
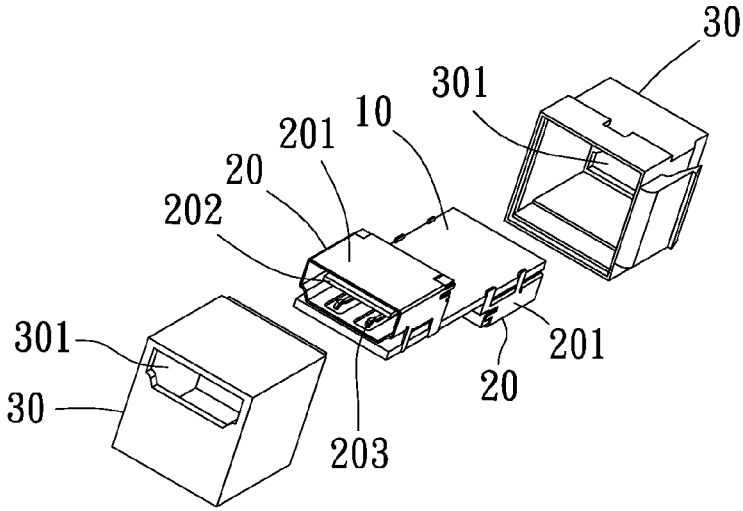
(PRIOR ART) FIG. 1
FIG. 1 is a disassembled perspective diagram of a conventional HDMI switcher.
Figure 2:
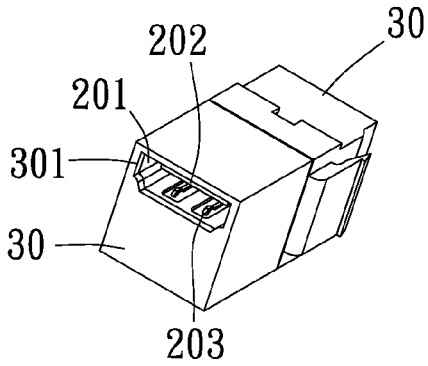
(PRIOR ART) FIG. 2
FIG. 2 is an assembled perspective diagram of the conventional HDMI switcher.
Figure 3:
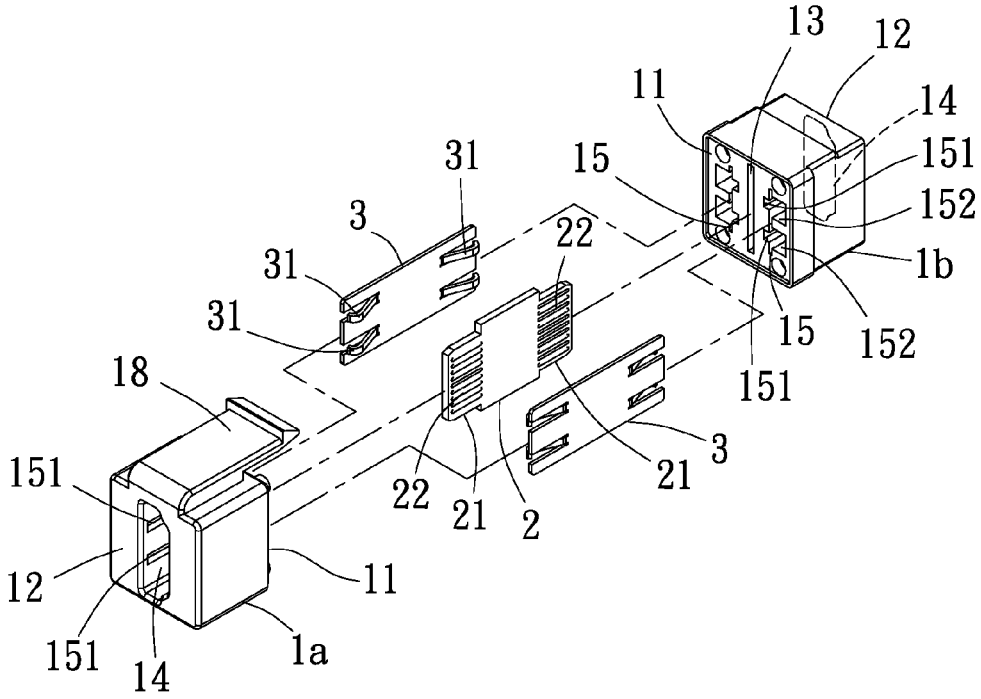
FIG. 3 is a disassembled perspective diagram according to a first embodiment of the present invention.

An HDMI audio-video signal switching device according to one embodiment of the present invention, as illustrated in FIG. 3, comprises a first housing body 1*a*, a second housing body 1*b*, and a conductively connecting circuit board 2. In this connection, referring to FIGS. 3 and 5, each of the first housing body 1*a* and the second housing body 1*b* is presented as an integrally formed rectangular or other shaped construction, made of insulating plastic, each having an assembling end 11 butted together, a plugged end 12 at an opposite side to the assembling end 11, a positioning slot 13 depressingly provided at the assembling end 11, and a plugged hole 14 depressingly provided at the plugged end 12. The positioning slot 13 of each of the first housing body 1*a* and the second housing body 1*b* is communicated with the plugged hole 14 thereof, respectively, and the shape of the plugged hole 14 of each of the first housing body 1*a* and the second housing body 1*b* is corresponded to that of the HDMI signal line plug. In FIG. 3, the internal structure of the assembling end 11 of the first housing body 1*a* is the same as that of the assembling end 11 of the second housing body 1*b*, while the internal structure of the plugged end 12 of the first housing body 1*a* is the same as that of the plugged end 12 of the second housing body 1*b*.

Referring to FIG. 3 again, the conductively connecting circuit board 2 is formed, at each of two ends thereof, with a plugging projection sheet 21. A portion between the plugging projection sheets 21 is provided in the positioning slots 13. The plugging projection sheets 21 are provided in the plugged holes 14, and used for connecting to the HDMI signal line plugs, respectively. On each of two surfaces of the plugging projection sheet 21, a plurality of conductively connecting terminals 22 in parallel are provided to be electrically connected with the HDMI signal line plug. Moreover, the conductively connecting terminals 22 of one plugging projection sheet 21 are electrically connected with those of the other, correspondingly.

Figure 4:
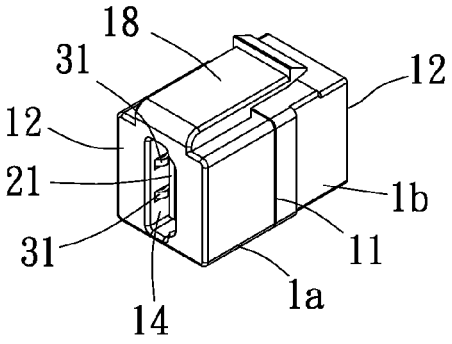
FIG. 4 is an assembled perspective diagram according to the first embodiment of the present invention.
Figure 5:
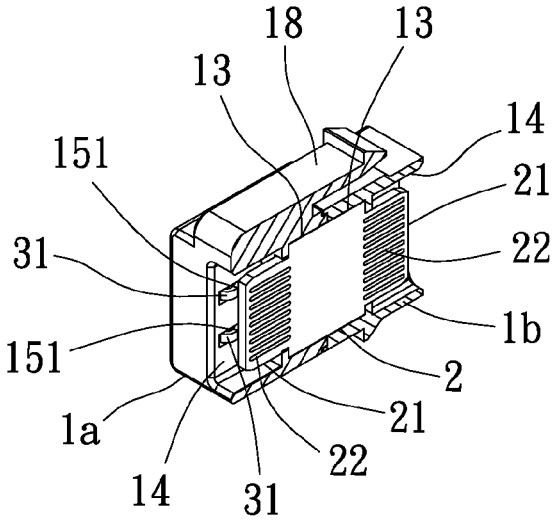
FIG. 5 is a first cross-sectional diagram according to the first embodiment of the present invention.

Referring to FIGS. 4 and 5, each of the two plugging projection sheets 21 of the conductively connecting circuit board 2 is inserted into the positioning slot 13 of each of the first housing body 1*a* and the second housing body 1*b*, in such a way that each plugging projection sheet 21 and the conductively connecting terminals 22 thereon pass through the positioning slot 13, and then extend into the plugged hole 14, respectively. When the conductively connecting circuit board 2 is insertingly connected with the first housing body 1*a* and the second housing body 1*b*, the assembling end 11 of the first housing body 1*a* and that of the second housing body 1*b* are then butted and assembled by means of ultrasonic fusing, so as to form the HDMI audio-video signal switching device of the present invention.

Figure 6:
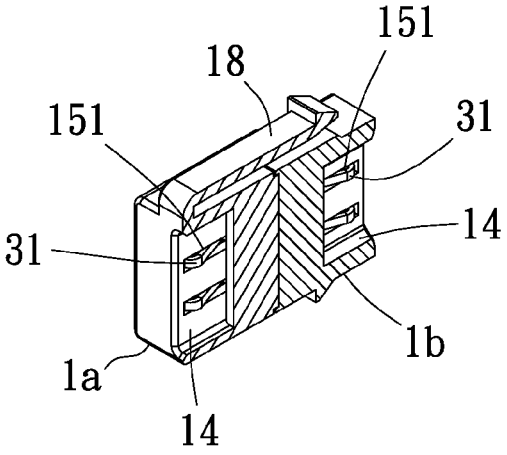
FIG. 6 is a second cross-sectional diagram according to the first embodiment of the present invention.

For fastening the HDMI signal line plug by the HDMI audio-video signal switching device of the present invention, referring to FIG. 3 again, two fixing sheets 3 are further included in the embodiment of the present invention. On one location, to which the plugging projection sheet 21 corresponds, of each fixing sheet 3, is provided with two fastening resilient sheets 31, respectively. At the assembling end 11 of each of the first housing body 1*a* and the second housing body 1*b*, two slots 15 are provided at two sides of the positioning slot 13. Two ends of each fixing sheet 3 are inserted into the slots 15 of the first housing body 1*a* and the second housing body 1*b*, respectively. Each of the fastening resilient sheets 31 of the fixing sheet 3 may pass through the wall surface between the slot 15 and the plugged hole 14, and then protrude into the plugged hole 14. Referring to FIGS. 3 and 6, each of the two ends of the fixing sheet 3 is inserted into the slot 15 of each of the first housing body 1*a* and the second housing body 1*b*, in such a way that each of the fastening resilient sheets 31 of the fixing sheet 3 may pass through the wall surface between the slot 15 and the plugged hole 14, and then protrude into the plugged hole 14. When the HDMI signal line plug is plugged into the plugged hole 14, it is then fastened by the fastening resilient sheets 31 of the fixing sheets 3.

Referring to FIG. 3 again, one wall surface between the slot 15 and the plugged hole 14 of each of the first housing body 1*a* and the second housing body 1*b* is provided with two guiding slots 151 corresponding to the fastening resilient sheets 31. The fastening resilient sheets 31 may pass through the guiding slots 151 and then protrude into the plugged hole 14. In addition, on the other wall surface of each slot 15 opposite to the guiding slots 151, there are provided with two motion permitting slots 152 corresponding to the guiding slots 151. In this connection, swinging into the motion permitting slot 152 is allowed for the fastening resilient sheet 31, when the HDMI signal line plug is plugged or unplugged.

In addition, referring to FIG. 4 again, the first housing body 1*a* may be provided thereon with a fixing hook portion 18, used for fixing the HDMI audio-video signal switching device to a predetermined fixed place, such as a wall, for example. Moreover, the fixing hook portion 18 may be also provided on the second housing body 1*b* as required.

Furthermore, referring to FIG. 3 again, the opening directions of the plugged holes 14 of the first housing body 1*a* and the second housing body 1*b*, respectively, are directed at 180 degrees with respect to each other. The two ends of the conductively connecting circuit board 2 are directed at 180 degrees with respect to each other, and the two ends of the fixing sheet 3 are directed at 180 degrees with respect to each other. Moreover, other structures related to the plugged hole 14, conductively connecting circuit board 2 and fixing sheet 3 may be also designed as 180-degree structure. Thereby, the conductively connecting circuit board 2 and each fixing sheet 3 are inserted into the positioning slots 13 and the slots 15, respectively, further forming the plugged holes 14 located at two directly opposite ends of the HDMI audio-video signal switching device.

The two plugged holes 14 of the present invention may be also embodied to direct toward other directions. In this embodiment, referring to FIGS. 7, 8 and 9, the opening directions of the plugged holes 14 of the first housing body 1*a* and the second housing body 1*b*, respectively, are designed to direct at 90 degrees with respect to each other, and the two ends of the fixing sheet are designed to direct at 90 degrees with respect to each other. Similarly, other structures related to the plugged hole 14, conductively connecting circuit board 2 and fixing sheet 3 may be also designed as 90-degree structure. Thus, the two plugging projection sheets 21 of the conductively connecting circuit board 2 are formed at the two ends of the circuit board perpendicular to each other, while each fixing sheet 3 is embodied as an L-shaped sheet. When the conductively connecting circuit board 2 and each fixing sheet 3 are inserted into the positioning slots 13 and the slots 15, respectively, of the first housing body 1*a* and the second housing body 1*b*, the two plugged holes 14 are then formed at two ends of the HDMI audio-video signal switching device perpendicular to each other.

Figure 7:
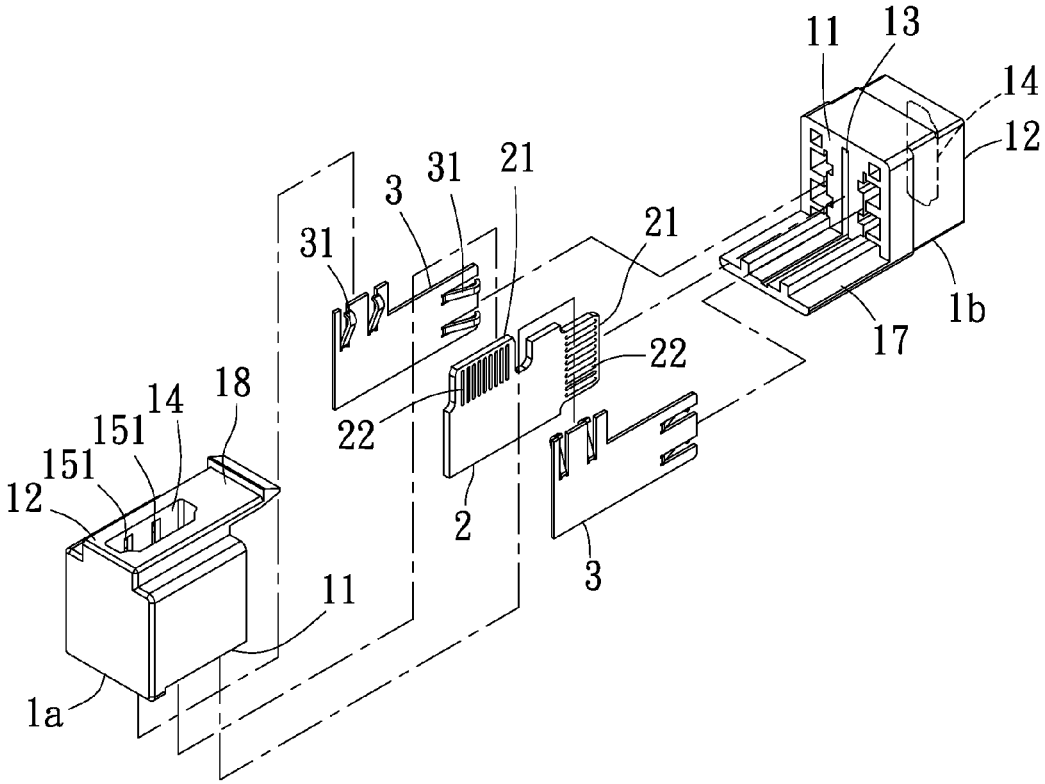
FIG. 7 is a disassembled perspective diagram according to a second embodiment of the present invention.
Figure 8:
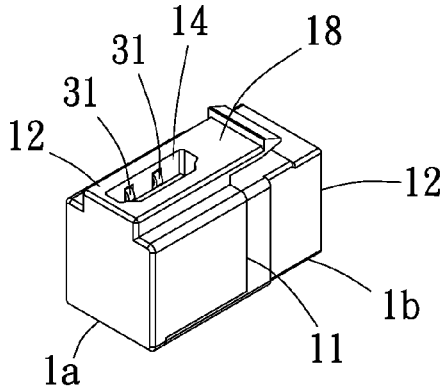
FIG. 8 is an assembled perspective diagram according to the second embodiment of the present invention.
Figure 9:
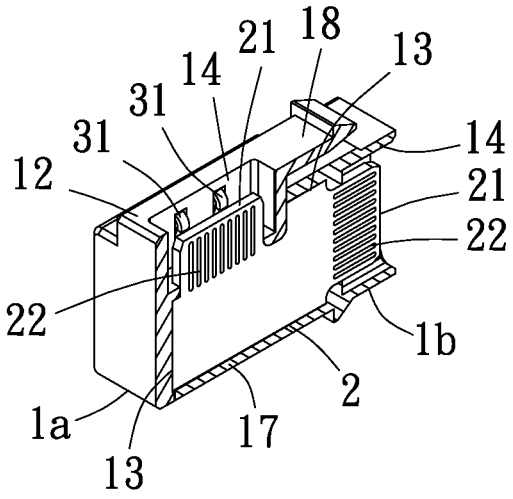
FIG. 9 is a first cross-sectional diagram according to the second embodiment of the present invention.
Figure 10:
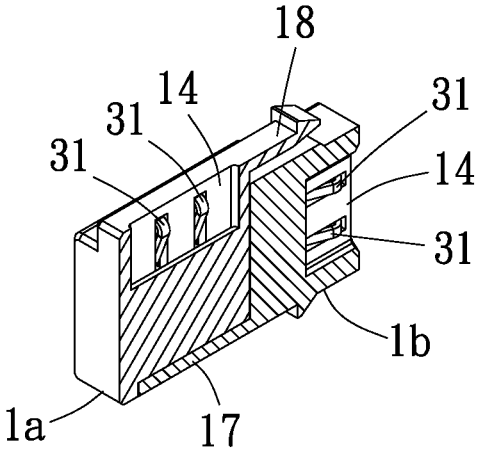
FIG. 10 is a second cross-sectional diagram according to the second embodiment of the present invention.

Referring to FIGS. 7, 9 and 10, the assembling end 11 of the second housing body 1*b* is projectingly provided with a covering sheet 17 covering the assembling end 11 of the first housing body 1*a*, Thereby, when the first housing body 1*a* and the second housing body 1*b* are butted together in the case that the L-shaped conductively connecting circuit board 2 and the fixing sheets 3 are insertingly assembled, the assembling end 11 of the first housing body 1*a* may be covered by the covering sheet 17 of the assembling end 11 of the second housing body 1*b*. In FIG. 7, the internal structure of the assembling end 11 of the first housing body 1*a* is the same as that of the assembling end 11 of the second housing body 1*b*, while the internal structure of the plugged end 12 of the first housing body 1*a* is the same as that of the plugged end 12 of the second housing body 1*b*.

Figure 11:
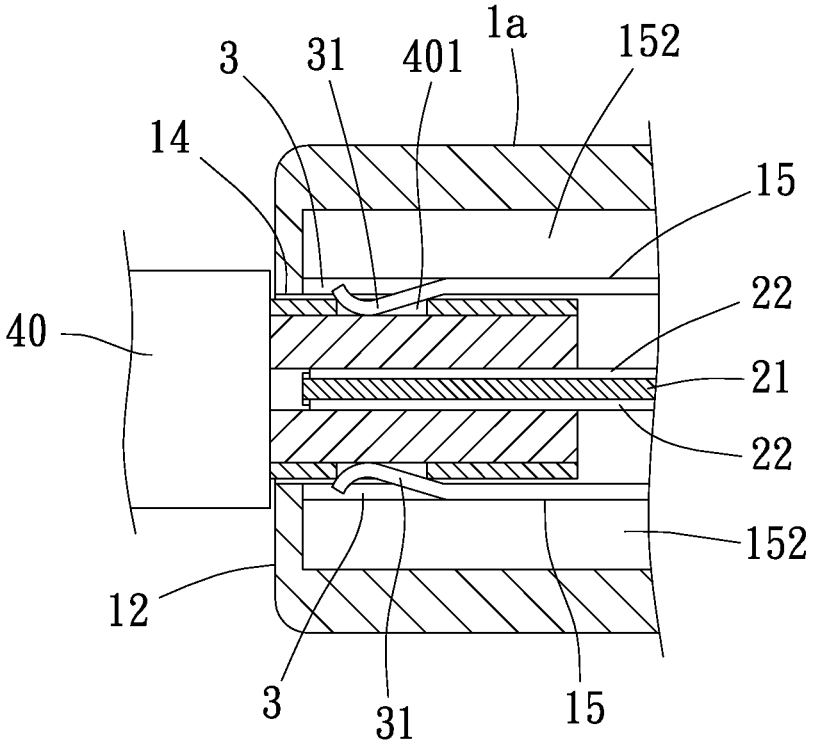
FIG. 11 is a cross-sectional diagram according to one embodiment of the present invention in operating condition.

In the improved structure of the HDMI audio-video signal switching device of the present invention, the structure of the conductively connecting circuit board 2 directly formed with the plugging projection sheets 21 and conductively connecting terminals 22, together with the structure design of the positioning slots 13 and plugged holes 14 of the first housing body 1*a* and second housing body 1*b*, may be used, such that the structure of HDMI audio-video signal switching device to be plugged with the HDMI signal line plugs is then formed when the plugging projection sheets 21 of the conductively connecting circuit board 2 are inserted into the positioning slots 13 and then extended to the plugged holes 14 of the first housing body 1*a* and second housing body 1*b*. Referring to FIG. 11, two HDMI signal line plugs 40 may be plugged into the plugged holes 14 at two ends, when switching HDMI signal is required. Thus, the function of connecting two HDMI signal line plugs 40 in series may be completed by the electrical connection between the conductively connecting terminals 22 on each surface of plugging projection sheet 21 of the conductively connecting circuit board 2 and the HDMI signal line plugs 40, as well as the fastening of the fastening resilient sheets 31 of the fixing sheets 3 into fastened holes 401 of the HDMI signal line plugs 40.

The present invention is disclosed by embodiments in foregoing description. However, it should be understood by those skilled in the art that the embodiments are merely used for describing the present invention and not considered as restrictive. It should be noted, that all equivalent variations and substitutions may be included within the scope of the present invention. Therefore, the present invention to be protected should be defined by appended claims.

What is claimed is:

1. An HDMI audio-video signal switching device, comprising:

a first housing body and a second housing body, each of the first and second housing bodies having an assembling end butted together, a plugged end opposite to said assembling end, a positioning slot provided at said assembling end, and a plugged hole provided at said plugged end, said positioning slot communicating with said plugged hole, wherein a shape of said plugged hole is configured to correspond to an HDMI signal line plug;

a conductively connecting circuit board formed at a first end and a second plugging projection sheet formed at a second end, a portion between said first plugging projection sheet and the second plugging projection sheet being provided in said positioning slots, said plugging projection sheets being provided in said plugged holes, respectively, said first and second plugging projection sheets configured to connect to said HDMI signal line plug at each said plug end, wherein two surfaces of each of said first and second plugging projection sheets being provided thereon with a plurality of conductively connecting terminals in parallel, said conductively connecting terminals configured to electrically connect with said HDMI signal line plugs, and said conductively connecting terminals of the first plugging projection sheet being electrically connected with the conductively connecting terminals of the second plugging projection sheet; and a first fixing sheet and a second fixing sheet, each of the first and second fixing sheets having a first end and a second end, the first fixing sheet and the second fixing sheet are each provided with two fastening resilient sheets at the first end and the second end;

wherein two slots are provided at two sides of each of said positioning slots, two ends of each of said first and second fixing sheets being inserted into said slots of said first housing body and said second housing body, respectively, each of said two fastening resilient sheets of said first and second fixing sheet passes through a wall surface between said slot and said plugged hole of each of the first and second housing bodies, and then protrudes into said plugged hole;

wherein one wall surface between said slot and said plugged hole of each of said first housing body and said second housing body being provided with two guiding slots corresponding to said two fastening resilient sheets, said two fastening resilient sheets passing through said guiding slots and then protruding into said plugged hole.

2. The HDMI audio-video signal switching device according to claim 1, wherein on the other wall surface of each of side slots opposite to said guiding slots, there are provided with two motion permitting slots corresponding to said guiding slots, said two fastening resilient sheets swinging within said motion permitting slots, respectively.

3. The HDMI audio-video signal switching device according to claim 1, wherein said first housing body is provided thereon with a fixing hook portion, used for fixing said HDMI audio-video signal switching device.

4. The HDMI audio-video signal switching device according to claim 1, wherein opening directions of said plugged holes of said first housing body and said second housing body, respectively, are directed at 180 degrees with respect to each other, and said first and second ends of said conductively connecting circuit board are directed at 180 degrees with respect to each other.

5. The HDMI audio-video signal switching device according to claim 1, wherein opening directions of said plugged holes of said first housing body and said second housing body, respectively, are directed at 180 degrees with respect to each other, said first and second ends of said conductively connecting circuit board are directed at 180 degrees with respect to each other, and said first and second ends of said first and second fixing sheet are directed at 180 degrees with respect to each other.

6. The HDMI audio-video signal switching device according to claim 5, wherein said assembling end of said second housing body is projectingly provided with a covering sheet covering said assembling end of said first housing body.

7. The HDMI audio-video signal switching device according to claim 1, wherein opening directions of said plugged holes of said first housing body and said second housing body, respectively, are directed at 90 degrees with respect to each other, and said first and second ends of said conductively connecting circuit board are directed at 90 degrees with respect to each other.

8. The HDMI audio-video signal switching device according to claim 7, wherein said assembling end of said second housing body is projectingly provided with a covering sheet covering said assembling end of said first housing body.

9. The HDMI audio-video signal switching device according to claim 1, wherein opening directions of said plugged holes of said first housing body and said second housing body, respectively, are directed at 90 degrees with respect to each other, said first and second ends of said conductively connecting circuit board are directed at 90 degrees with respect to each other, and said first and second ends of said fixing sheet are directed at 90 degrees with respect to each other.

* * * * *